United States Patent [19]

Orlando

[11] Patent Number: 4,729,319

[45] Date of Patent: Mar. 8, 1988

[54] CONTROLLED EXPLOSION PROJECTILE EJECTION SYSTEM

[76] Inventor: Edward Orlando, 823 Georgia St., Key West, Fla. 33040

[21] Appl. No.: 10,328

[22] Filed: Feb. 3, 1987

[51] Int. Cl.[4] ..... F42B 4/00

[52] U.S. Cl. ..... 102/351; 102/352; 102/440; 102/202.8; 102/202.9

[58] Field of Search ..... 102/350, 351, 352, 202.8, 102/202.9, 440

[56] References Cited

U.S. PATENT DOCUMENTS

| | | | |
|---|---|---|---|
| 3,343,921 | 9/1967 | Braun | 102/202.8 X |
| 4,007,691 | 2/1977 | Haake | 102/334 |
| 4,026,212 | 5/1977 | Dardick | 102/531 |
| 4,285,153 | 8/1981 | Crouch | 102/202.5 |
| 4,531,458 | 7/1985 | Saxby | 102/440 |
| 4,539,969 | 9/1985 | Saxby | 102/440 X |
| 4,593,602 | 6/1986 | Faix | 102/352 X |

*Primary Examiner*—Peter A. Nelson

*Attorney, Agent, or Firm*—John C. Malloy

[57] ABSTRACT

The controlled explosion projectile ejection system utilizes a source of combustible gas through a controllable input valve into a combustion chamber. Inside the combustion chamber is a sparking means. After the chamber is loaded or filled with gas, a spark control signal is applied to the sparking means and the gas ignites. At the output of the chamber is disposed a controllable output valve. In a simple embodiment, the output valve is simply a valve head biased against the output port of the chamber thereby inhibiting any gas flow from the chamber unless the pressure in the chamber exceeds the biasing force against the valve head. After ignition, the gas expands and the resulting pressure is much greater than the biasing force on the output valve head and the valve opens. Downstream of the output valve is a barrel with the projectile loaded therein. The expanding gas passes through the output valve and ejects the projectile from the barrel.

20 Claims, 3 Drawing Figures

CONTROLLED EXPLOSION PROJECTILE EJECTION SYSTEM

BACKGROUND OF THE INVENTION

The present invention relates to a system which ejects or propels projectiles and particularly to a system wherein the explosion within the ejection system is controlled.

It is commonly recognized that weapons and fire arms utilize bullets that are comprise a projectile, gun powder, a primer to ignite the gun powder and a casing which retains these three elements in a compact unit. To fire the weapon, the primer and powder are ignited and the projectile is propelled from the barrel of the weapon. Thereafter, the casing is ejected and another bullet is placed into the barrel from a magazine that stores a plurality of bullets.

This prior art system is limited in that the explosion of the powder is always uniform. In some cases, it is desirable to affect the explosion which propels the projectile from a weapon. The present invention fulfills this need.

OBJECTS OF THE INVENTION

It is an object of the present invention to provide a controlled explosion in a projectile ejection system thereby enabling an operator to affect the force acting upon the projectile and thereby change the muzzle velocity of the projectile.

It is another object of the present invention to provide a projectile ejection system which utilizes combustible gas.

It is another object of the present invention to provide a projectile ejection system which has less moving parts than the prior art systems.

It is a further object of the present invention to utilize positive and negative feedback control systems in order to control the force acting upon the projectile.

It is another object of the present invention to provide a system which is cooled by gas.

It is a further object of the present invention to provide a projectile ejection system which utilizes a gas to load the projectiles from a magazine into the barrel of the system.

SUMMARY OF THE INVENTION

The controlled explosion projectile ejection system utilizes a source of combustible gas to eject or propel a projectile from a barrel. The combustible gas, or combustible gas mixture, is fed from the gas supply through a controllable input valve into a combustion chamber. A sparking means is disposed inside the combustion chamber. After the chamber is loaded or filled with gas, a spark control signal is applied to the sparking means and the gas ignites. At the output of the chamber is disposed a controllable output valve. In a simple embodiment, the output valve is simply a valve head biased against the output port of the chamber thereby inhibiting any gas flow from the chamber unless the pressure in the chamber exceeds the biasing force against the valve head. After ignition, the gas expands and the resulting pressure is much greater than the biasing force on the output valve head and the valve opens. Downstream of the output valve is the barrel with the projectile loaded therein. The gas passes through the output valve into the barrel and forces the projectile out of the barrel. In other embodiments, the pressure in the chamber is sensed and the input or output valves are appropriately controlled to obtain a controlled explosion. In another embodiment, the volume of gas from the gas supply is measured and the input valve is appropriately opened or closed. In either case, the operator of the system can set the thresholds of the feedback control systems to limit the amount of the combustible gas in the chamber and hence control the force acting on the projectile and therefore affect the muzzle velocity and the speed of the projectile.

BRIEF DESCRIPTION OF THE DRAWINGS

Further objects and advantages of the present invention can be found in the detailed description of the preferred embodiments thereof when taken in conjunction with the accompanying drawings in which.

DETAILED DESCRIPTION OF THE PREFERRED EMBODIMENTS

The present invention relates to a projectile ejection system and particularly relates to a system where in the force applied to the projectile can be varied by controlling the explosion of combustible gasses in a chamber upstream of the projectile.

Figure 1:
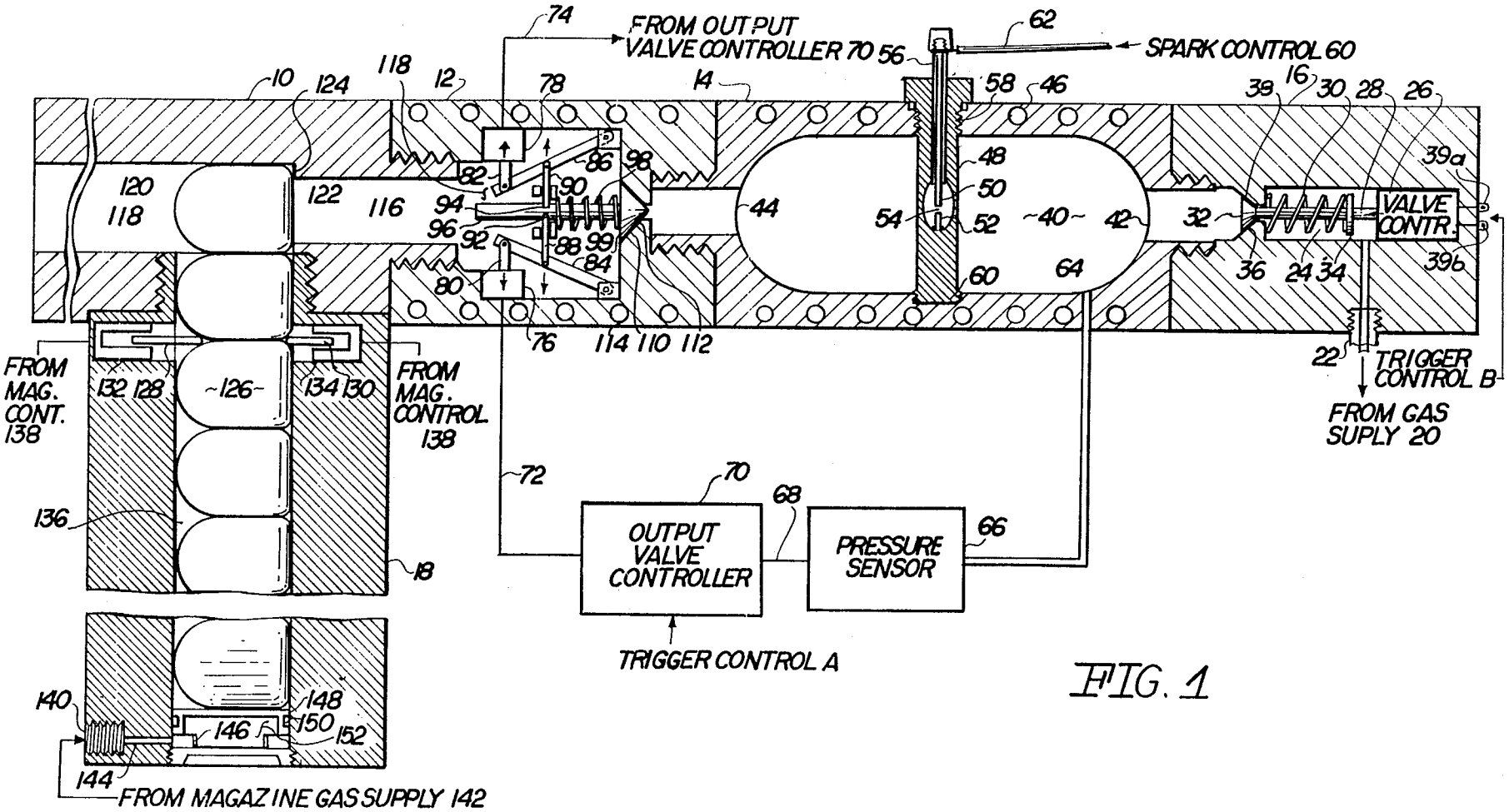
FIG. 1 schematically illustrates the projectile ejection system in accordance with the principles of the present invention.

FIG. 1 shows a schematic of the projectile ejection system in accordance with one embodiment of the invention. The system includes barrel section 10, output valve section 12, chamber section 14, input valve section 16, and magazine section 18. Combustible gas from gas supply 20 is fed via piping 22 into input valve chamber 24. The input valve includes valve control 26, valve rod 28, biasing spring 30, and valve head 32. One end of spring 30 is adjacent at one axial end of valve chamber 24 and the other end of spring 30 is adjacent spring retainer 34 that is affixed to rod 28. Valve head 32 has conical surface 36 that conforms with and mates to frustoconical valve seat 38 in input valve section 16.

The input valve is a one-way valve in that when valve control 26 moves valve rod 28 in the direction shown by the arrow, combustible gas from gas supply 20 flows through chamber 24, passes valve head 32 and enters combustion chamber 40. Valve control 26 is open based upon a trigger control signal B applied to electric connection terminals **39*a* and 39*b*. The valve is a one-way valve because if the pressure in chamber 40 exceeds the pressure in valve chamber 24, valve head 32 firmly seats against valve seat surface 38**.

Chamber section 14 includes gas input port 42, gas output port 44 and a plurality of cooling passages one of which is designated as passage 46. A sparking device 48 includes spark lead 50, and grounded lead 52 that is spaced from lead 50 by sparking gap 54. Lead 50 is insulated from the body of sparking mechanism 48 by insulation 56. Lead 50 is electrically connected to conductor wire 60. Sparking device 48 is threadably affixed to chamber section 14 at threaded region 58 and threaded region 60 that are located in opposing sides of chamber 40.

A spark control signal 60 is applied to electrical conductor wire 62 and a spark jumps from lead 50 across gap 54 to lead 52 because chamber section 14 is electrically grounded as compared with spark control signal 60.

In a preferred embodiment, chamber section 14 is an elongated cylindrical body that defines combustion chamber 40 therein. The cooling passages encircle chamber 40 in order to remove excess heat generated by the explosion following ignition of the combustible gas in chamber 40.

A small gas sensor port 64 allows pressure sensor 66 to produce a signal representative of the pressure in chamber 40. This signal is applied to electrical line 68 and ultimately to output valve controller 70. Valve controller 70 also receives trigger control signal A. The output from valve controller 70 is applied to electrical line 72 as well as to line 74 and is consequently applied to unlocking actuators 76 and 78 within output valve section 12.

For example, unlocking mechanism 76 and 78 could be solenoids which move linking pins 80 and 82 in the direction as indicated by the arrows in FIG. 1. Actuator arms 84 and 86 are hinged to linking arms 80 and 82 and are hinged at their other ends to the body of output valve section 12. This movement of the actuator arms causes locking pins 88 and 90 (hinged to the midsection of actuator arms 84 and 86) to move as shown by the respective arrows. This causes the pins to exit complementary notches or locking seats 92 and 94 in valve rod 96. A pair of guide posts on the left and righthand side of both locking pins 88 and 90 ensure that the pins are aligned with the notches when the valve is closed. The guide posts on the right of locking pins 88 and 90 also act upon one end of spring 98. The other end of spring 98 rests against valve head 99. Valve head 99 has conical valve surface 110 which snugly fits and mates with frustoconical valve seat 112 formed in output valve section 12.

In a similar fashion to chamber section 14, output section 12 includes cooling passages in the body of the section generally near its periphery. One of those passages identified as passage 114.

Barrel section 10 includes an input bore 116 that is open to output valve chamber 118. Input bore 116 expands into output bore 118 within which is disposed a projectile 120.

The rear end 122 of projectile 120 is seated against ledge 124 that generally defines the boundaries between input bore 116 and output bore 118.

Immediately below projectile 120 is magazine section 18 that includes a plurality of projectiles, one of which is projectile 126. Projectile 126 is prohibited from moving into bore 118 due to movable latch bars 128 and 130. Latch bars 128 and 130 are moved back and forth by controllers 132 and 134. For example, controllers 132 and 134 could be solenoids and latch bars 128 and 130 could be biased inward into magazine bore 136 by springs. Bore 136 holds a plurality of aligned projectiles, one of which is projectile 126.

Controllers 132 and 134 receive a signal from magazine control 138 substantially simultaneously.

At the lower end of magazine section 18, port 140 receives gas from magazine gas supply 142. That gas is delivered to bore 136 via gas passages 144 and a series of circumferential apertures or ports, one of which is port 146 at one end of bore 136. A movable piston head 148 includes a seal (such as an O ring) circumferentially between head 148 and the inner surface of section 18 defining bore 136. The seal can be placed along the periphery of piston head 148 in circumferential groove 150. By maintaining a gas pressure in bore portion 152, piston head 148 acts upon the lower-most aligned projectile and when latch bars 128 and 130 move outward from magazine bore 136, projectile 126 moves upward if projectile 120 has been previously ejected from output bore 118 of barrel section 10.

The ejection system can be controlled in various ways dependent principally upon the control signals applied to the input and output valves. For example in one embodiment, the operator activates a trigger mechanism (not shown in FIG. 1) and the trigger mechanism sequentially produces trigger control signal B and then spark control signal 60. The presence of trigger control signal B activates valve control 26 and the input valve opens allowing a selected amount of gas into combustion chamber 40. After trigger control signal B is removed, the input valve closes thereby seating valve head 32 against valve seat 38. Spark control signal 60 is then sequentially produced and an electric arc appears across spark gap 54 due to the voltage differential between leads 50 and 52. This spark ignites the combustible gas in chamber 40.

The output valve in this embodiment could be simply a pressure sensitive valve that opens when the pressure at its input exceeds the spring force acting on the downstream side of the valve head. The gas passes through the output valve and ejects the projectile loaded in the barrel. In another embodiment, locking pins 88 and 90 in output valve section 12 are either not utilized or unlocked such that the valve is a pressure sensitive valve. The locking pin mechanism can be thought of as a safety for the system. Pressure sensor 66 is not used. Output valve controller 70 only responds to trigger control signal A which is an unlock command signal. This sequential mode of operation contemplates a timer T (see FIG. 3) to open up the input valve for a predetermined time, close the valve and then to apply a spark control signal.

In another mode of operation that utilizes a positive feedback system, the input valve is opened and allows a predetermined amount of combustible gas into chamber 40. The valve is closed, sparking device 48 generates a spark in gap 54 and the gas ignites. Pressure sensor 66 generates a signal on line 68 to output valve controller 70. Controller 70 determines whether the pressure representative signal on line 68 exceeds a threshold value established by trigger control signal A. When the pressure signal does exceed that threshold, controller 70 issues an unlock command signal on lines 72 and 74 which activate unlocking actuator mechanisms 76 and 78. Linking arms 80 and 82 move as shown thereby concurrently moving locking pins 88 and 90 in a similar direction and allowing the output valve to open at that controlled high pressure. This is the positive feedback control system in that pressure is sensed in combustion chamber 40 and then the output valve is open after the pressure exceeds an input value that is based principally upon trigger control signal A.

A third mode of operation for the ejection system could be to sequentially time the application of trigger control signal B, the application of spark control signal 60 and then trigger control signal A. By sequentially activating the input valve, the spark control and then the output valve, a desired amount of force could be applied via the expanding gasses on end face 122 of projectile 120.

When projectile 120 leaves output bore 118 of barrel section 10, a new projectile is loaded into the barrel as discussed above with respect to the magazine section 18.

Figure 2:
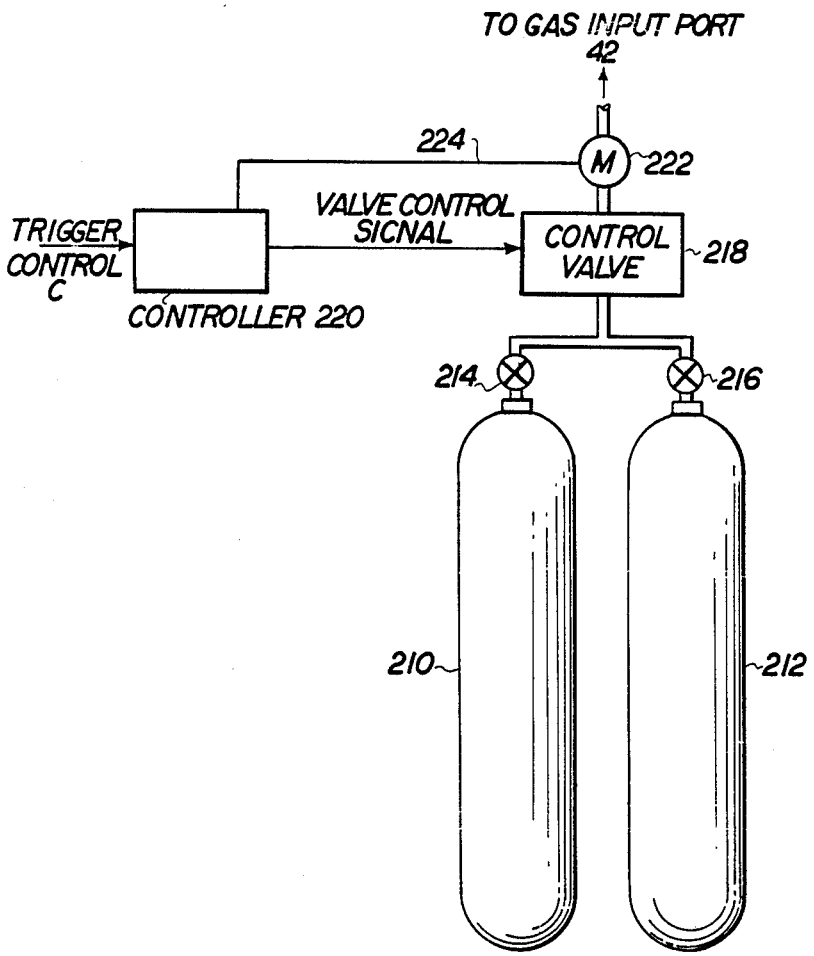
FIG. 2 schematically illustrates a gas supply subsystem and a negative feedback control for an embodiment of the ejection system in accordance with the principles of the present invention; and, FIG. 3 is a schematic of the overall ejection system in accordance with the principles of the present invention.

FIG. 2 is a schematic illustration of one type of combustible gas delivery subsystem for the projectile ejection system in accordance with the principles of the present invention. Cartridge-like tank 210 in this embodiment contains gaseous oxygen and cartridge-like tank 212 contains a combustible hydrocarbon gas. Valves 214 and 216 control the mix of the oxygen and hydrocarbon gas and control valve 218 is controlled by a valve control signal from controller 220. Downstream of control valve 218 is a meter 222 that can measure either pressure or volume. A signal representative of either the pressure or the volume is applied to line 224 and fed back to the controller 220. A trigger control signal C is fed into controller 220. Again, several modes of operation can be utilized in conjunction with this projectile ejection system.

One mode of operation supplies a uniform unit volume of gas to chamber 40 shown in FIG. 1. In this situation, meter 222 measures volume and controller 220 compares the signal on line 224 with a predetermined value and opens and closes control valve 218 based upon the comparison. Trigger control signal C in this mode is an ON/OFF control signal for controller 220. Thereafter, the gas is ignited and ejected as described above.

Another mode of operation is to utilize a pressure sensitive meter 222 and simply measure the pressure at the output of control valve 218. Of course, the pressure measured by meter 222 is substantially similar to the pressure measured by pressure sensor 66 in FIG. 1 since both sensors are adjacent port 42. When the pressure downstream of control valve 218 reaches a predetermined value (stored in controller 220), the valve control signal commands the closure of the control valve. The sequential generation of the spark control signal and the trigger control signal A then occurs. These last few modes are negative feedback systems.

In another embodiment, the amplitude (or other characteristic) of trigger control signal C represents the volume amount or the pressure of the combustible gas to be placed in combustion chamber 40. For example, if the amplitude of trigger control C were utilized, a low amplitude indicates that one unit volume of gas is to be placed in combustion chamber 40. Hence, a relatively small explosion occurs and less force acts upon end surface 122 of projectile 120. A higher amplitude trigger control signal C, for example three times greater the initial signal, indicates a three fold increase in the volume of gas (three unit volumes) delivered to the chamber. This volume is metered by meter 222 and, based upon a comparison of the volume signal on line 224 and a variable threshold value stored in controller 220, the control valve is opened and closed. Three volume units of combustible gas in combustion chamber 40 translates into a much greater force acting upon projectile 120 and hence greater ejection and muzzle velocity of the projectile.

It should be noted that this two tank system is not essential because complex hydrocarbon gasses are currently commercially available which do not require the mixing of oxygen. This single gas embodiment is meant to be covered by the claims appended hereto. Also, the control systems described above could utilize gas, fluid or mechanical means rather than electrical signals to control the valves.

In the initial stages of development, a very simple projectile ejection system was produced. A ½ inch brass T fitting was utilized. An automobile spark was placed in the middle outlet of the T fitting. At one end of the T fitting, a brass reducer fitting was interposed between the T fitting and an inner tube air valve. At the other end of the T fitting, a brass plug was placed. A bore was made through the brass plug and 22 caliber pellets were placed in the bore. A mixture of oxygen and acetylene gas (a 50 percent mixture) was placed in the chamber defined within the T brass fitting. A spark was generated across the plug gap of the spark plug and the 22 caliber pellets were ejected 40 feet. Further tests propelled the pellets up to 100 feet. These tests proved the theory of the present invention.

Figure 3:
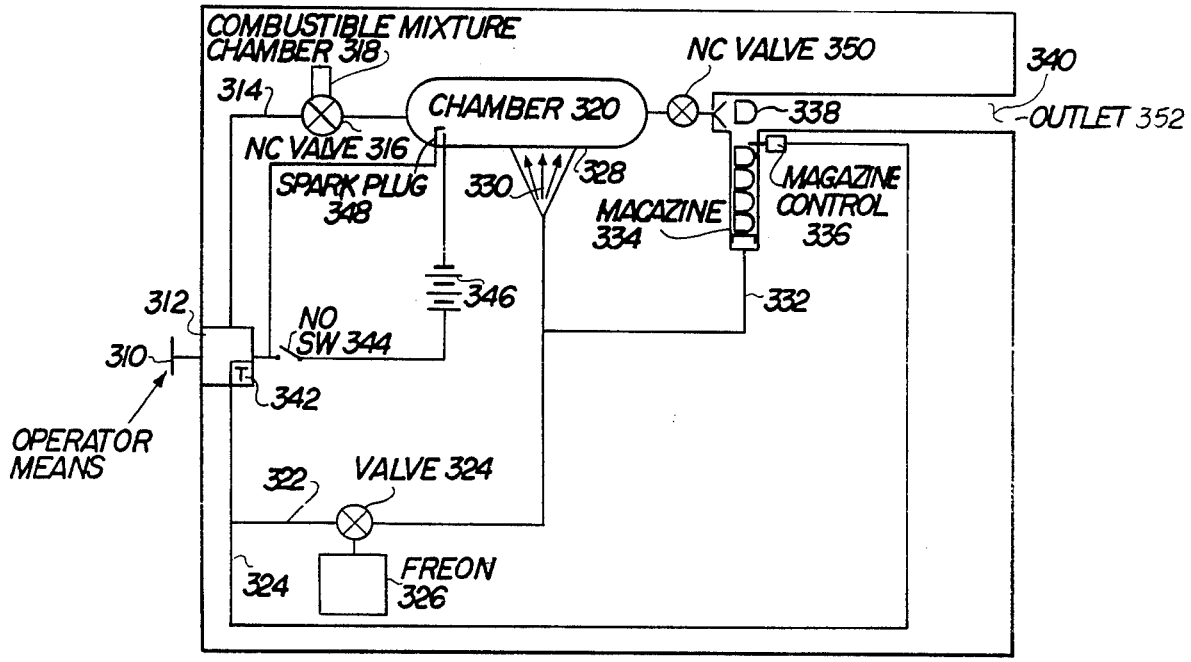

FIG. 3 shows a general schematic of the present invention. The operator actuates trigger 310 that is connected to controller 312. The controller issues an input valve command signal on line 314 to normally closed valve 316 coupling combustible mixture chamber 318 to combustion chamber 320.

In one embodiment, substantially simultaneous to input command signal on line 314, a cooling command signal, that doubles as a magazine control command, is applied to lines 322 and 324 respectively. Cooling command signal on line 322 opens valve 324 linking coolant source (in this embodiment freon gas) 326 to cooling jacket 328. This passage of coolant gas around the chamber is illustrated by arrows 330. The coolant gas also is applied to line 332 and acts as a biasing means in magazine 334. The magazine signal on line 324 is fed to magazine control 336 such that a projectile 338 is placed in output bore 340.

After these activities, controller 321 has timer T 342 which times out the sequence and eventually closes a normally opended switch 344 thereby coupling battery 346 to spark plug 348. As a safety precaution prior to closure of switch 344, the various signals on lines 314, 322 and 324 may be reversed in order to close various valves and lock certain features. Spark plug 348 ignites the combustible gas in chamber 320, and normally closed valve 350 then opens (possibly only by the degree of pressure in chamber 320) thereby allowing the expanding gas in chamber 320 to enter the end of bore 340, propelling projectile 338 through the bore and ejecting the projectile from outlet 352.

The claims appended hereto are meant to cover modifications and changes within the scope and spirit of the present invention. For example, the design of a particular valves may be altered and still be within the scope of the present invention. The locking mechanism in the output valve may be eliminated. The variable control features of the input valve may be eliminated. In other words, both these valves may work based principally on the spring forces acting on the valve head versus the output or input pressures as discussed hereinabove. The size and shape of the combustion chamber may be altered dependent upon the dynamic characteristics of the expanding gas. Also, joints between the various sections, shown as male and female threads, is only exemplary. The magazine section may be altered significantly since any type of projectile delivery subsystem can be used in conjunction with the present invention. The coolant need not be freon gas but may be other types of gasses or liquids that cool allow the combustion chamber. The claims appended hereto are meant to cover these items.

What I claim is:

1. A controlled explosion projectile ejection system utilizing a source of combustible gas and ejecting a projectile based upon an input command signal from a generator, the system comprising:

a combustion chamber means having a gas input port and a gas output port;

a controllable sparking means for receiving said input command signal and producing a spark inside said chamber means;

a one-way input valve intermediate said source of combustible gas and said gas input port controlling the amount of combustible gas passing therethrough into said chamber means;

a barrel means, within which is disposed said projectile, attached to said chamber means at said gas output port;

a cooling jacket about said chamber means having passages through which pass a freon gas coolant; and, wherein a controlled amount of said combustible gas is fed into said chamber means via said input valve, said combustible gas explodes by said spark from said sparking means based upon said input command signal and due to the expansion of said combustible gas, said projectile is ejected from said barrel means.

2. The system as claimed in claim 1 including an operator actuated firing means generating a fire signal sequentially comprising an input valve open signal and a spark control signal as said input command signal; said input valve being a controllable, normally biased closed, input valve that receives and is controllably opened by said input valve open signal; wherein said sparking means generates said spark to ignite said combustible gas after said input valve fills said chamber means with said combustible gas due to the sequential application of said input valve open signal and spark control signal.

3. The system as claimed in claim 1 wherein said combustible gas is a hydrocarbon gas.

4. The system as claimed in claim 1 wherein said input valve is a controllable input valve that is controlled by a valve input signal and the system includes means for generating said valve input signal and applying the same to said input valve.

5. The system as claimed in claim 4 wherein said means for generating said valve input signal includes means for measuring the volume of gas passing through said input valve and said means for generating generates a close valve input signal, that is part of said valve input signal, when a predetermined volume of gas passes said input valve.

6. The system as claimed in claim 4 wherein said means for generating said valve input signal includes means for measuring the pressure of gas downstream of said input valve and said means for generating generates a close valve input signal, that is part of said valve input signal, when a predetermined pressure is sensed downstream of said input valve.

7. The system as claimed in claim 1 wherein said combustible gas is a mixture of oxygen and acetylene gas.

8. The system as claimed in claim 7 including an oxygen supply cartridge tank, an acetylene supply cartridge tank and a mixing valve means for mixing said oxygen and acetylene gases to obtain said combustible gas.

9. A controlled explosion projectile ejection system utilizing a source of combustible gas and ejecting a projectile based upon an input command signal from a generator, the system comprising:

a combustion chamber means having a gas input port and a gas output port;

a controllable sparking means for receiving said input command signal and producing a spark inside said chamber means;

an input valve intermediate said source of combustible gas and said gas input port controlling the amount of combustible gas passing therethrough;

a barrel means, within which is disposed said projectile, attached to said chamber means at said gas output port;

an output valve intermediately disposed between said output port and said barrel means, said output valve being biased closed by a biasing means towards said output port;

a controllable locking mechanism that maintains said output valve in a closed position until an unlock control signal is applied to said locking mechanism;

a pressure sensor having access to the inside of said chamber means and generating a pressure signal representative of the pressure in said chamber means, and an output valve controller receiving said pressure signal and generating an unlock control signal when said pressure signal exceeds a threshold value;

wherein a controlled amount of said combustible gas is fed into said chamber means via said input valve, said combustible gas explodes by said spark from said sparking means based upon said input command signal and due to the expansion of said combustible gas, said projectile is ejected from said barrel means.

10. The system as claimed in claim 9 wherein said input valve is a one-way valve that only allows gas flow into said chamber means.

11. The system as claimed in claim 10 wherein said combustible gas is a hydrocarbon gas.

12. The system as claimed in claim 10 wherein said chamber means includes a cooling jacket thereabout to limit the temperature thereof, said cooling jacket having passages through which passes a coolant.

13. The system as claimed in claim 10 including means for retaining a plurality of projectiles and means for loading single projectiles into said barrel means.

14. The system as claimed in claim 10 wherein said threshold value is controllably variable and the system includes means for inputting a chamber pressure value that is representative of the controlled variable threshold value.

15. The system as claimed in claim 11 wherein said chamber pressure value is indicative of the force applied to said projectile and hence the muzzle velocity of the system.

16. The system as claimed in claim 11 including an operator actuated firing means generating a fire signal sequentially comprising an input valve open signal and a spark control signal as said input command signal; said input valve being a controllable, normally biased closed, input valve that receives and is controllably opened by said input valve open signal; wherein said sparking means generates said spark to ignite said combustible gas after said input valve fills said chamber means with said combustible gas due to the sequential application of said input valve open signal and spark control signal.

17. The system as claimed in claim 11 wherein said input valve is a controllable input valve that is controlled by a valve input signal and the system includes means for generating said valve input signal and applying the same to said input valve.

18. The system as claimed in claim 17 wherein said means for generating said valve input signal includes means for measuring the volume of gas passing through said input valve and said means for generating generates a close valve input signal, that is part of said valve input signal, when a predetermined volume of gas passes said input valve.

19. The system as claimed in claim 17 wherein said means for generating said valve input signal includes means for measuring the pressure of gas downstream of said input valve and said means for generating generates a close valve input signal, that is part of said valve input signal, when a predetermined pressure is sensed downstream of said input valve.

20. The system as claimed in claim 11 wherein said combustible gas is a mixture of oxygen and acetylene gases and the system includes an oxygen supply cartridge tank, an acetylene supply cartridge tank and a mixing valve means for mixing said oxygen and acetylene gases to obtain said combustible gas.

* * * * *